US006789521B2

(12) United States Patent
Ashida et al.

(10) Patent No.: US 6,789,521 B2
(45) Date of Patent: Sep. 14, 2004

(54) VALVE SYSTEM FOR ENGINE

(75) Inventors: Takashi Ashida, Shizuoka (JP); Atsushi Sawabuchi, Shizuoka (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 94 days.

(21) Appl. No.: 10/117,920

(22) Filed: Apr. 5, 2002

(65) Prior Publication Data

US 2002/0174846 A1 Nov. 28, 2002

(30) Foreign Application Priority Data

Apr. 5, 2001 (JP) ..... 2001-107433

(51) Int. Cl.[7] ..... F01L 13/08

(52) U.S. Cl. ..... 123/182.1; 123/90.16; 123/90.17; 123/321; 123/322

(58) Field of Search ..... 123/182.1, 90.16, 123/90.17, 321, 322

(56) References Cited

U.S. PATENT DOCUMENTS

| | | | | |
|---|---|---|---|---|
| 1,439,798 | A | | 12/1922 | Crane |
| 3,511,219 | A | * | 5/1970 | Esty ..... 123/182.1 |
| 4,369,741 | A | | 1/1983 | Perrin |
| 5,816,208 | A | | 10/1998 | Kimura |
| 6,073,599 | A | | 6/2000 | Kimura |
| 6,173,689 | B1 | | 1/2001 | Tanaka |
| 6,176,211 | B1 | | 1/2001 | Tanaka et al. |
| 6,227,323 | B1 | | 5/2001 | Ashida |
| 6,343,579 | B1 | | 2/2002 | Yasuyama et al. |

FOREIGN PATENT DOCUMENTS

| | | |
|---|---|---|
| CH | 278376 | 10/1951 |
| EP | 1070833 | 1/2001 |
| EP | 02 00 7660 | 2/2003 |
| JP | 03182613 | 8/1991 |
| JP | 2000257411 | 9/2000 |

* cited by examiner

*Primary Examiner*—Noah Kamen
(74) *Attorney, Agent, or Firm*—Knobbe, Martens, Olson & Bear, LLP

(57) ABSTRACT

A decompression system for a four-cycle engine includes a decompression shaft positioned within a camshaft. The decompression shaft interacts with decompression pins positioned within pin holes formed in the camshaft. In some embodiments, the decompression shaft is formed from a first longitudinal portion and a second longitudinal portion. In other embodiments, the decompression shaft is supported at least in part by a middle portion of a bore that extends through the camshaft.

34 Claims, 6 Drawing Sheets

VALVE SYSTEM FOR ENGINE

RELATED APPLICATIONS

This application is based upon Japanese Patent Application No. 2001-107433, filed on Apr. 5, 2001, which is hereby expressly incorporated by reference in its entirety.

BACKGROUND OF THE INVENTION

1. Field of the Invention

This invention relates generally to a valve system of a four cycle engine and more particularly to an engine decompression system for the valve system.

2. Description of the Related Art

Many four cycle engines include a decompression system to make starting the engine easier. Such decompression systems are desired because of the high compression ratios that are often used in four-cycle engines. The high compression ratios produce large compression forces that must be overcome by an operator or a starter motor to start the engine. The decompression system reduces these forces by opening the exhaust valves and thereby effectively reducing the compression ratio when starting the engine.

There are several types of decompression systems. See, e.g., U.S. Pat. Nos. 4,369,741, 5,816,208 and 6,343,579. In U.S. Pat. No. 5,816,208, the decompression system includes a decompression actuating shaft that is inserted into a bore formed within a camshaft. The decompression actuating shaft actuates pins that are moveably positioned within pinholes positioned within the camshaft. When actuated by the decompression actuating shaft, the pins lift the exhaust valves to reduce the compression ration.

SUMMARY OF THE INVENTION

A need exists for an improved decompression system that is easy to manufacture and assemble and is also reliable. In particular, in engines with multiple cylinders (e.g., three or more), the camshaft and decompression actuating shaft become increasingly long. This tends to increase the difficult and costs of manufacture and assembly and to reduce reliability.

In one embodiment of the present invention, a decompression system for a four-cycle engine comprises a camshaft, decompression shaft, and at least one decompression pin. The camshaft has at least one cam arranged to activate a valve of the engine and an internal bore that extends generally longitudinally with respect to the camshaft. The camshaft also includes at least one pin hole arranged generally perpendicular to the internal bore. The decompression shaft comprises a first longitudinal portion and a second longitudinal portion that are configured to fit within the internal bore of the camshaft. The decompression shaft is moveable between a first position and a second position and further comprises at least one cam surface having a first portion and a second portion. The cam surface is arranged such that in the first position of the decompression shaft the first portion of the cam surface allows the decompression pin to withdraw and in a second position of the decompression shaft the second portion of the cam surface causes the decompression pin to protrude and lift the valve.

In another aspect of the present invention, a method of assembling a decompression system for an engine comprising forming a bore within the camshaft, the bore having a middle portion with a first diameter and a second portion with a second diameter that is larger than the first diameter, forming at least one pin hole in the camshaft, the pin hole extending generally perpendicular to a longitudinal axis of the camshaft, inserting a pin into the pin hole, forming a first portion of a decompression shaft, forming a second portion of a decompression shaft, and inserting the first portion and second portions of the decompression shaft into the bore.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENT

Figure 1:
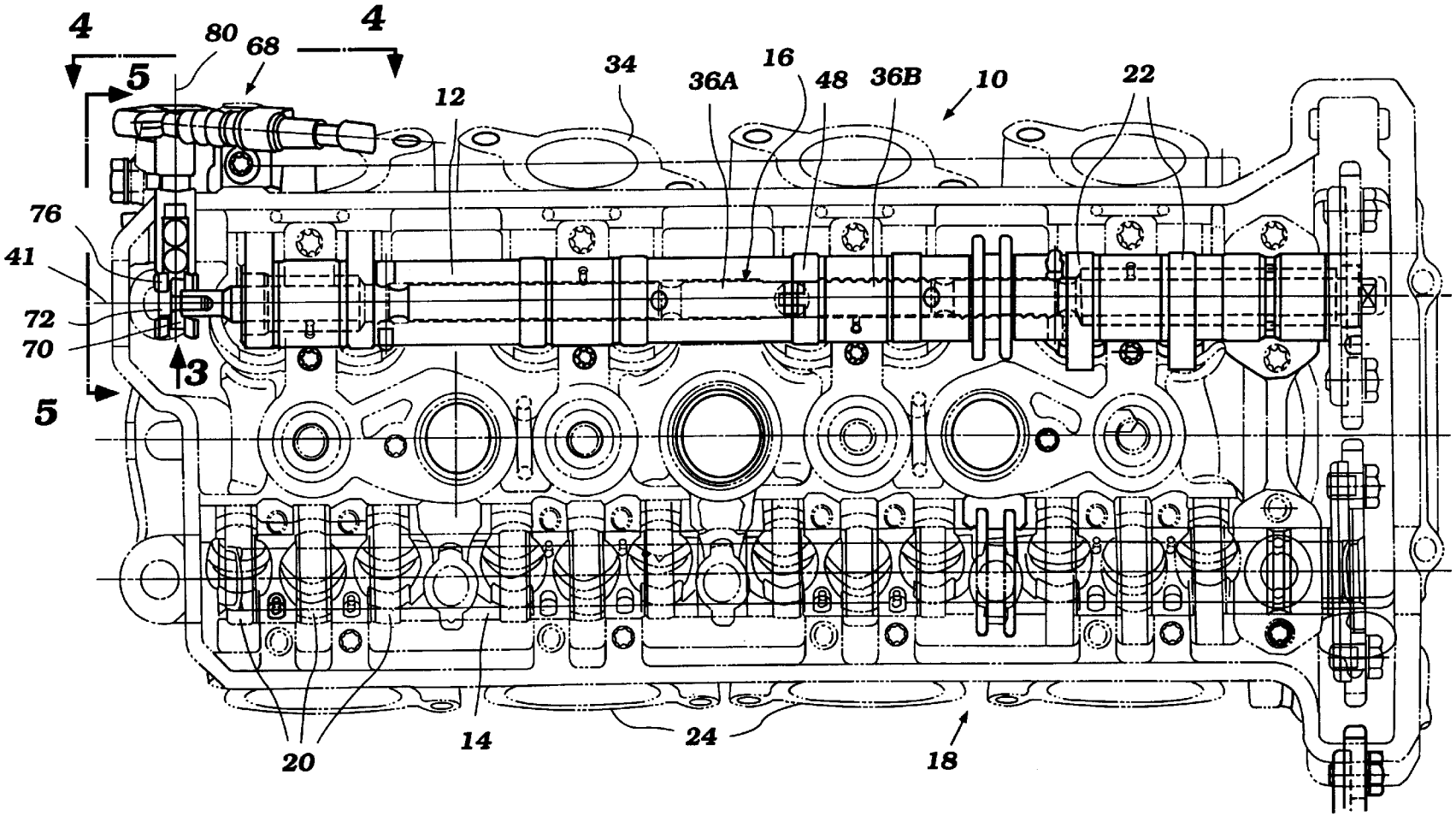
FIG. 1 is a schematic top plan view of a cylinder head of a four cylinder, four-cycle engine having an exhaust camshaft and a decompression system with certain features and advantages according to a preferred embodiment of the present invention.

FIGS. 1–6B illustrate a valve system 10 of a four-cycle engine. The valve system includes an exhaust camshaft 12, an intake camshaft 14 and a decompression system 16 having certain features and advantages of the present invention. Because the present invention deals primarily with the configuration of the valve system and the decompression system, only the portions of an engine that form or directly cooperate with the valve and decompression systems 10, 16 are illustrated in the figures. The remaining elements of the engine that are not illustrated or described in detail may be considered to be conventional and are well known to those of ordinary skill in the art.

With initial reference to FIG. 1, the exhaust and intake camshafts 12, 14 are shown positioned within the cylinder head 18 of the engine in a "dual overhead" arrangement. In the illustrated arrangement, the engine includes four cylinders with three intake valves and two exhaust valves associated with each cylinder. As such, the intake camshaft includes three intake cams 20 for each cylinder (i.e., twelve total) and the exhaust camshaft includes two exhaust cams 22 for each cylinder (i.e., eight total). Those of skill in the art will recognize the illustrated engine as an in-line, four cycle, four-cylinder engine. However, it should be appreciated that several features and advantages of the present invention may be achieved in an engine having a different arrangement (e.g., V-type), more or less cylinders, more or less intake and exhaust valves and operating on a different combustion principle (e.g., two-cycle or compression).

The intake cams 20 open and close intake valves as is well known in the art. The intake valves control the flow of an intake charge into the combustion chamber. In the illustrated embodiment, the intake charge is delivered to the combustion chambers through intake passages that are formed in the cylinder head 18 and are connected to an induction system through a series of intake pipes 24. In a similar manner, the exhaust cams 22 open and close exhaust valves 26 (see FIGS. 2A and 5). In the illustrated embodiment, the exhaust valves 26 (as well as the intake valves) include compression springs 28 for biasing the valves 26 to a closed position and a bearing surface 30 of a tappet 31 for contacting the exhaust cams 22 and intake cams 20 respectively. The exhaust is expelled from the combustion chamber through an exhaust passage 32 (see FIG. 5) that is formed in the cylinder head 18 and is connected to a series of exhaust pipes 34.

The camshafts 12, 14 are suitably journalled for rotation within the cylinder head 18 by a series of bearings as is well known in the art. The camshafts 12, 14 are preferably driven by the engine's crankshaft by a flexible transmitter (e.g.,. a timing belt) at one half the crankshaft speed.

The decompression system 16 will now be described with initial reference to FIGS. 2A and 2B. The decompression system 16 includes a decompression shaft 34, which in the illustrated embodiment comprises a first portion 36A and a second portion 36B. The first and second portions are coupled together at a coupling point 38 that is preferably located near the center of the exhaust camshaft 12.

The exhaust camshaft 12 includes a bore 40 in which the decompression shaft 34 is positioned. In the illustrated embodiment, the bore 40 extends completely through the exhaust cam shaft 12. However, in modified arrangements, the bore 40 can have only one opening and/or extend only partially through the exhaust camshaft 12. Preferably, the bore 40 is formed such that the decompression shaft 34 and the exhaust camshaft 12 have the same longitudinal axis 41.

The areas of the exhaust camshaft 12 near or adjacent at least one of the exhaust cams 22 associated with each cylinder include a pin hole 42. Within each pin hole 42, there is provided a decompression pin 44. The pin holes 42 are arranged such that the decompression pins 44 are generally aligned with a bearing surface 30 of the tappet 31 of one of the exhaust valves 26 as will be explained in more detail below. Each pin hole 42 is generally perpendicular to the longitudinal axis 41 of the exhaust camshaft 12 and each decompression pin 44 is biased by a biasing member (e.g., a coil spring) such that the decompression pin is biased towards the longitudinal axis 41 (i.e., the center of the bore 40).

In the illustrated arrangement, the decompression system 16 includes three decompression pins 44 positioned within three pin holes 42. Each decompression pin is aligned with one of the two exhaust valves 26 that is associated with each cylinder. However, it should be appreciated that in modified embodiments, the decompression system 16 can include more or less pin holes 42 and decompression pins 44 that are arranged for actuating more or less of the exhaust vales 26. Moreover, in still other embodiments, the pin holes 42 and decompression pins 44 may be arranged for actuating the exhaust valves 26 of only some of the cylinders.

As mentioned above, the bore 40 is preferably open at both ends of the exhaust camshaft 12. In addition, the bore 40 preferably includes a larger diameter portion 46A, 46B at both open ends and smaller diameter first middle portions 46C between the larger diameter portions. The coupling point 38 of the decompression shaft 34 is preferably located within a second middle portion 46D near the center of the camshaft 12 between the first middle portions 46C. The second middle portion 46D of the bore 40 forms a bearing surface 48, which is also indicated by the shaded area 50 of FIGS. 2A and 2B. The second diameter portion 46D preferably has a smaller diameter than the middle portions 46C described above. Moreover, the second middle portions 46D preferably has a smoother surface and is preferably machined more accurately than the first middle portions 46C of the bore 40. The diameter of the first middle portion 46C is preferably slightly larger than the diameter of the decompression shaft 34. As such, a small gap 47 lies between the first middle portions 46C and the decompression shaft 34. The two ends of the decompression shaft 34 are supported by bearing collars 52, which are preferably positioned within the larger diameter portions 46A, 46B of the bore 40 near or more preferably at the end of the camshaft 12. The coupling point 38 of the decompression shaft 34 is supported by the bearing surface 48. This is arrangement is advantageous because the portions larger diameter portions 46A, 46B, 46C do not need to be machined as smoothly or as accurately as the second middle portion 46D. Such an arrangement reduces the costs and the difficulties associated with manufacturing the camshaft 12.

Associated with each decompression pin 44, the decompression shaft 34 includes a plurality of actuating members 54. In the illustrated embodiment, each actuating member comprises a ring-like cam groove 56, which preferably has a generally smooth, curved cross-sectional shape; however, other cam shapes are also possible. In a non-activated position of the decompression shaft (see FIG. 2A), the grooves 56 are aligned with the pin holes 42. As such, the decompressions pins 44, which are biased towards the longitudinal axis 41, sink into the grooves 56 and do not extend significantly past the outer surface 58 of the camshaft 12. Thus, in the non-activated position, the decompression pins have no or a very small effect on the position of the exhaust valve 26. In contrast, when the decompression shaft 34 is in the activated position (see FIG. 2B), the decompression pins 44 are no longer aligned with the grooves 56 but contact an outer surface 57 of the decompression shaft 34. As such, the ends of the decompression pins 44 are forced out of the pin holes 42 such that the decompression pins 44 protrude from the outer periphery 58 and push on the bearing surface 30 of the exhaust valve 26. The pin holes 42 are preferably positioned on the camshaft 12 such that the exhaust valves 26 are lifted during the compression stroke of the associated cylinder. In this manner, the decompression pins 44 "lift" the exhaust valves 26 from a normally closed position and effectively reduce the effective compression ratio of the engine.

Longitudinal movement of the decompression shaft 34, therefore, switches the decompression system 16 between the activated and non-activated states. To facilitate the movement of the decompression pins 44 in and out of the cam groove 56, the decompression pins 44 preferably include a corresponding smooth, curved cam surface 59 as best seen in FIG. 2B. This cam surface 59 interacts with the groove 56 such that the decompression shaft 34 can slide smoothly over the pins 44.

Figure 2A:
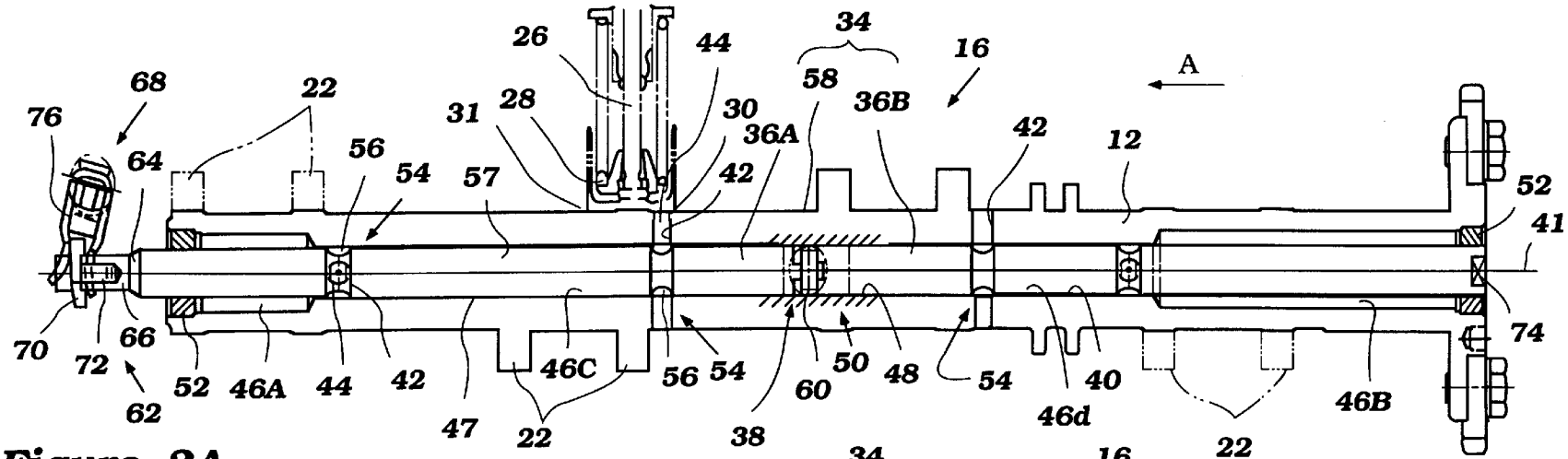
FIG. 2A is a cross-sectional view of the exhaust camshaft of FIG. 1 and illustrates the decompression system in a non-activated position.
Figure 2B:
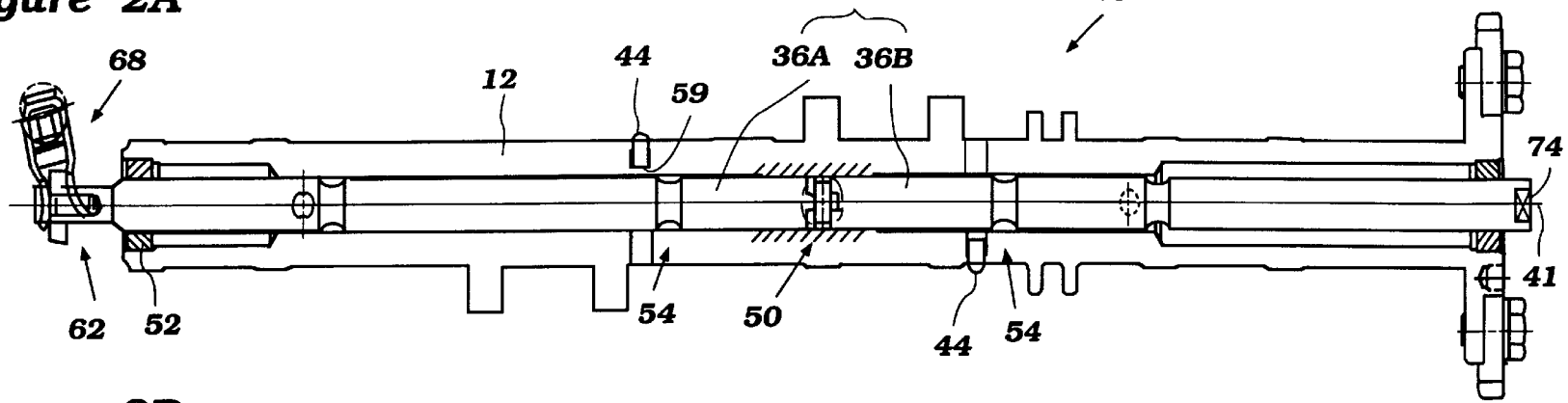
FIG. 2B is a cross-sectional view of the exhaust camshaft of FIG. 1 and illustrates the decompression system in an activated position.
Figure 3:
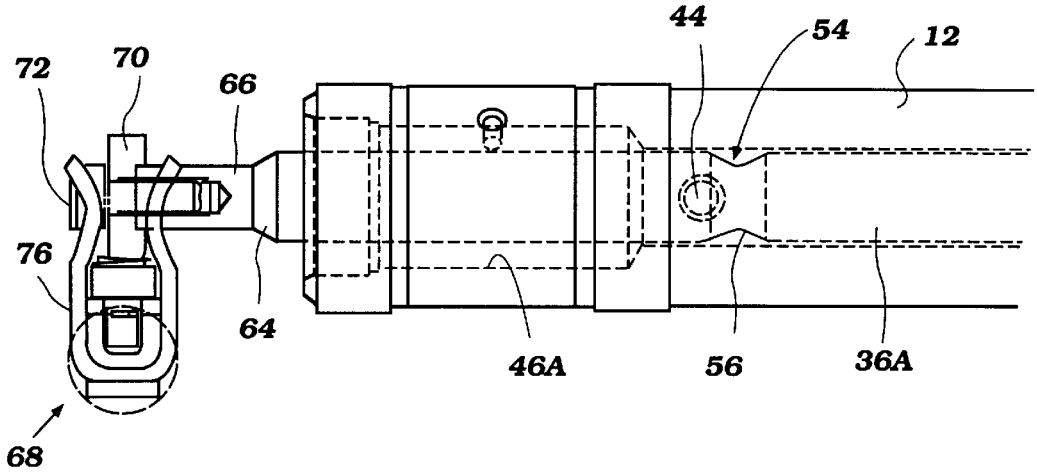
FIG. 3 is an enlarged view of one end of the decompression system as seen in the direction of arrow 3 in FIG. 1.

With continued reference to FIGS. 2A and 2B and the illustrated embodiment, the first and second portions 36A, 36B of the decompression shaft 34 are coupled together at the coupling point 38 via a tongue and groove arrangement, which is secured by a pin 60 that extends through apertures formed in the tongue and groove arrangement. In modified embodiments, the portions 36A, 36B may be coupled in other manners. For example, a key, hook or serration arrangement may be used to couple the two portions 36A, 36B together. In another modified embodiment, the first portion 36A may be threaded into the second portion 36B. In still another modified embodiment, the two portions 36A, 36B can be simply be in contact with each other (i.e., uncoupled). In such an arrangement, a biasing member is needed to bias the decompression shaft into either the activated or non-activated position. The key and serration arrangements are particularly useful in an arrangement wherein the decompression shaft is rotated between the first and second positions as will be described below.

A first end 62 of the decompression shaft 34 preferably extends from the camshaft 12 in both the activated and non-activated positions (see FIGS. 2A and 2B). This end 62 of the shaft 34 preferably includes a tapered portion 64,which transitions the diameter of the shaft 34 to smaller diameter portion 66. This arrangement is preferred because it facilitates assembly of the decompression system 16. Specifically, during assembly, the small diameter portion 66 of the decompression shaft 34 is first inserted into the bore 40 of the camshaft 12. As the decompression shaft 34 is moved through the bore 40 in the direction indicated by the arrow A of FIG. 2A, the small diameter portion 66 and the tapered portion 64 gradually push the biasing members and decompression pins 44 inside the pin holes 42 such that the decompression shaft 34 can be smoothly inserted into the bore 40.

A drive apparatus 68 for actuating the decompression shaft 34 will now be described with reference to FIGS. 2A–6B. In the illustrated embodiment, the drive apparatus 68 includes a washer 70, which may be coupled to the first end 62 of the shaft 34 by a bolt 72.

The decompression shaft 34 preferably includes a recess or protrusion 74 with one or more flat sides on the second or opposite end 75 of the shaft 34. The recess or protrusion 74 is used to prevent rotation of the shaft 34 when the washer 70 is being coupled to the shaft 34 by a bolt 72.

Figure 4:
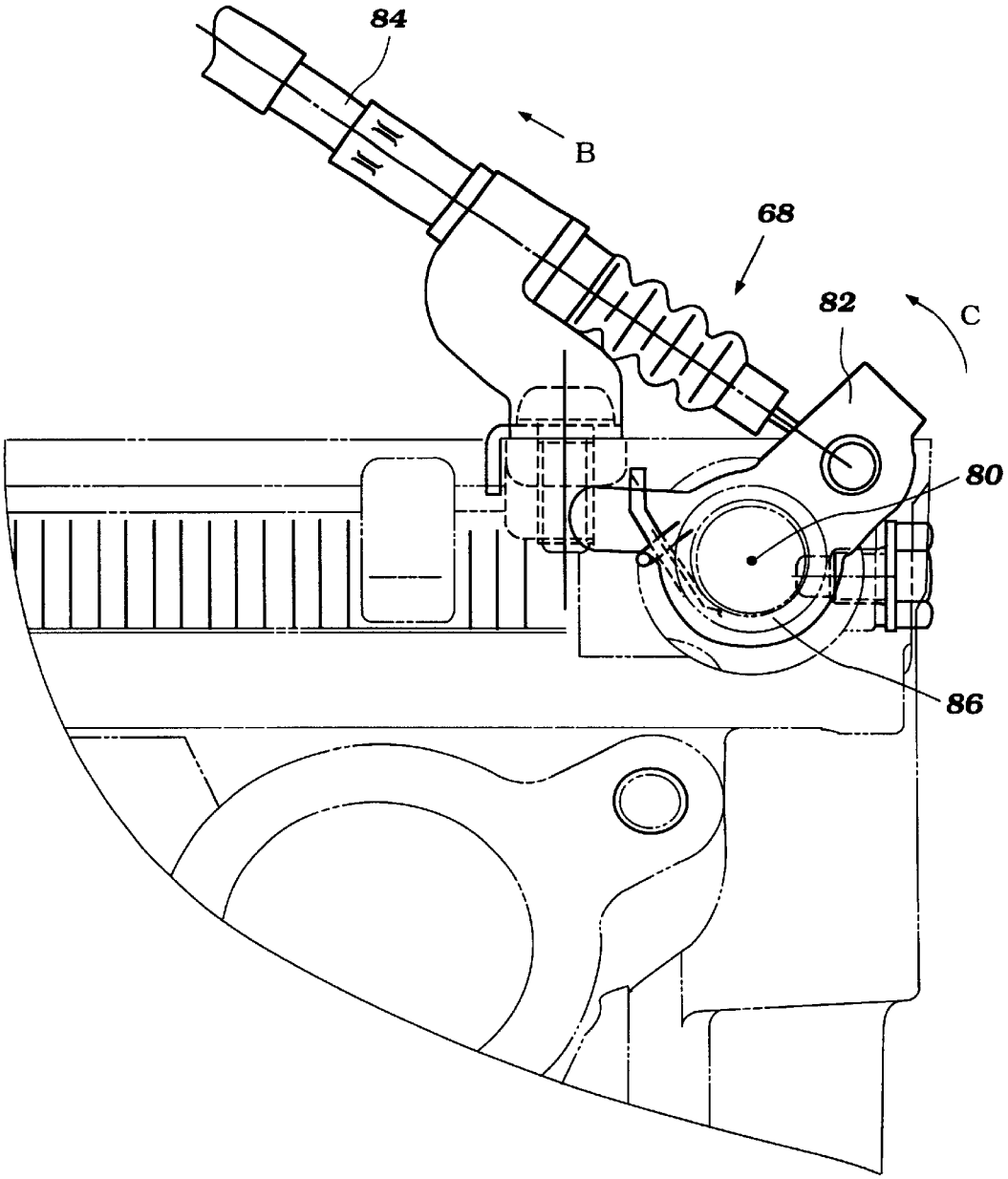
FIG. 4 is an enlarged view of a drive apparatus of the decompression system as seen in the direction of arrows 4—4 in FIG. 1.
Figure 5:
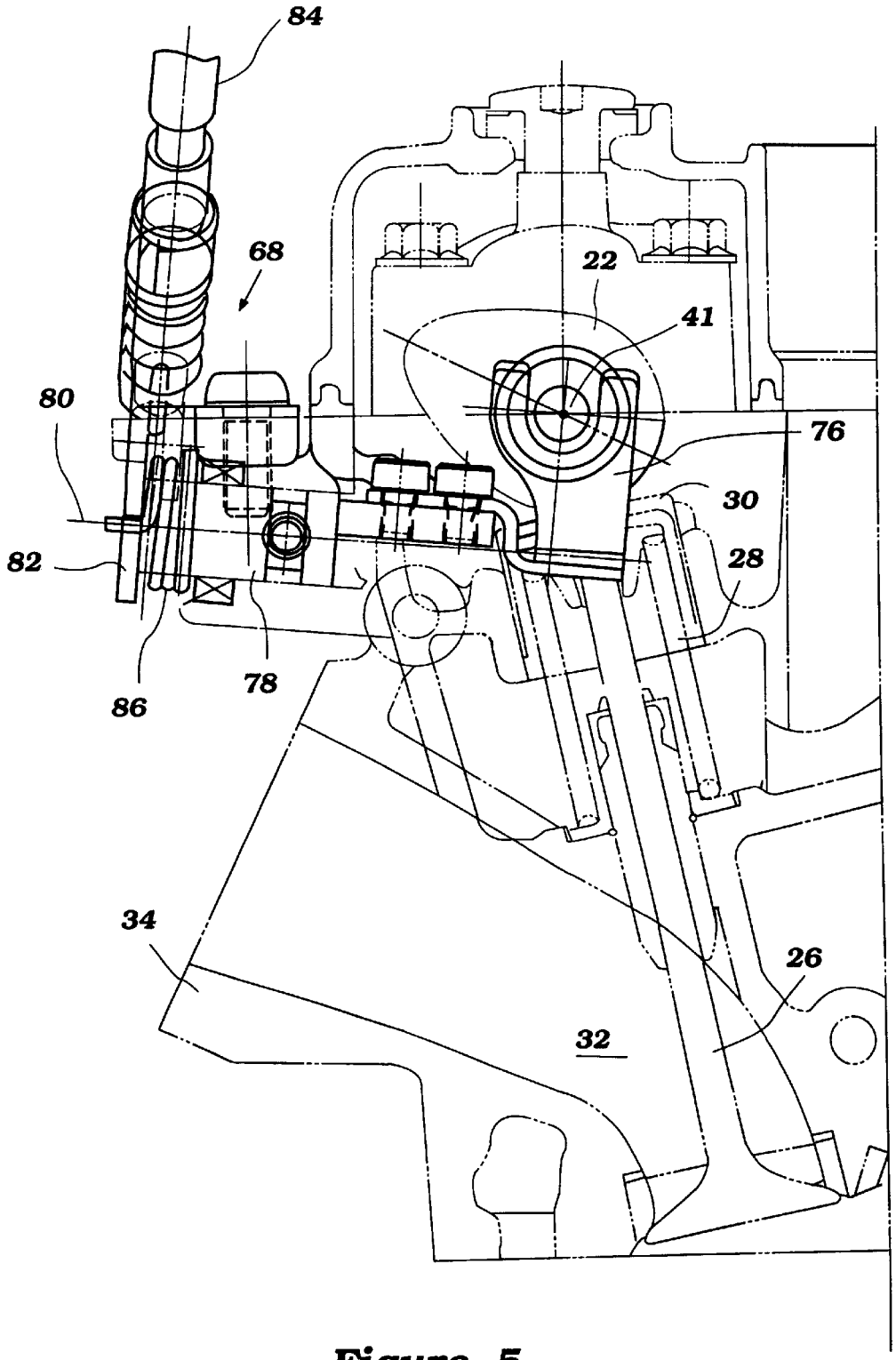
FIG. 5 is an enlarged view of the drive apparatus of the decompression system as seen in the direction of arrows 5—5 in FIG. 1.

A clamp 76 is coupled to the washer 70. In the illustrated embodiment, the claim 76 includes a first leg 77A and a second leg 77B define a channel in which the washer 70 is positioned. In some arrangements, the legs 77A, 77B can be biased towards the washer 70 to positively hold the washer 70. In other arrangements, the legs 77A, 77B are arranged so as to only contact the washer 70. The clamp 70 pivots about a stay 78, which has an axis 80 that is generally perpendicular to the longitudinal axis 41 of the camshaft as best seen in FIGS. 1 and 5. The clamp 70 is coupled to a bracket 82, which also pivots about the stay 78 as seen in FIG. 4. The bracket 82, in turn, is coupled to a bowden-wire 84, which may be coupled to an actuator provided near a control panel for the engine. For example, the wire 84 may be coupled to a lever provided on a handlebar. In a modified embodiment, the bowden-wire is arranged so as to be activated when a starter motor is activated such that the decompression system 16 is automatically activated.

As best seen in FIG. 4, a torsional spring 86 is preferably provided on the stay 78. The torsional spring 86 preferably biases the decompression system 16 to a nonactivated position (i.e., the position shown in FIG. 2A).

Figure 6A:
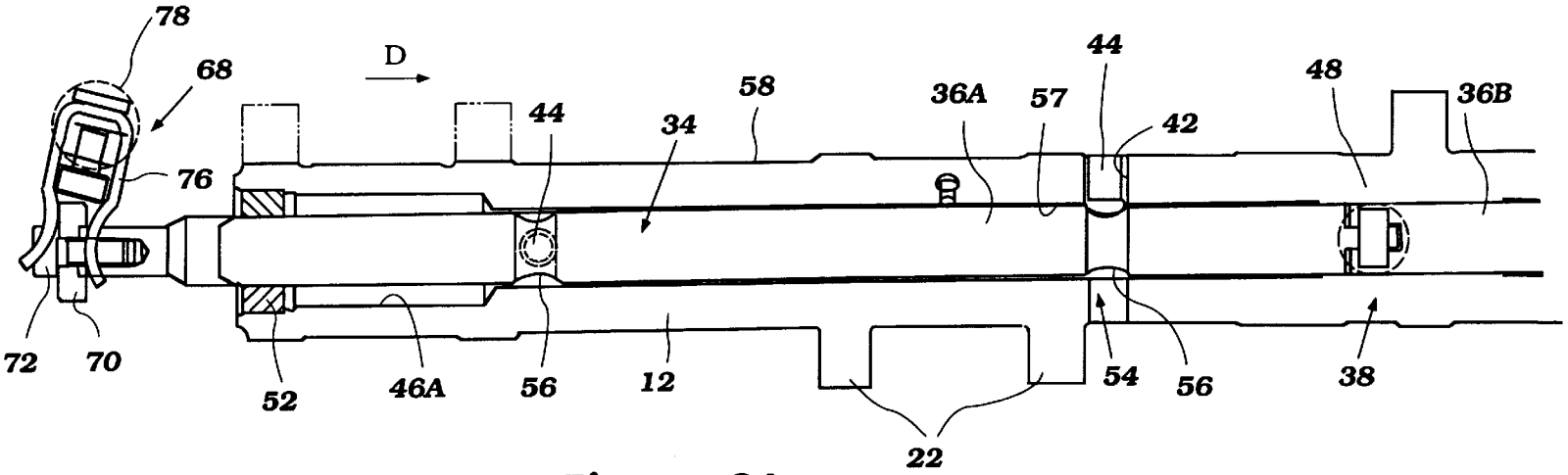
FIG. 6A is an enlarged cross-sectional view of a portion of the exhaust camshaft the decompression shaft of FIG. 2A, showing the decompression system in a non-activated position.
Figure 6B:
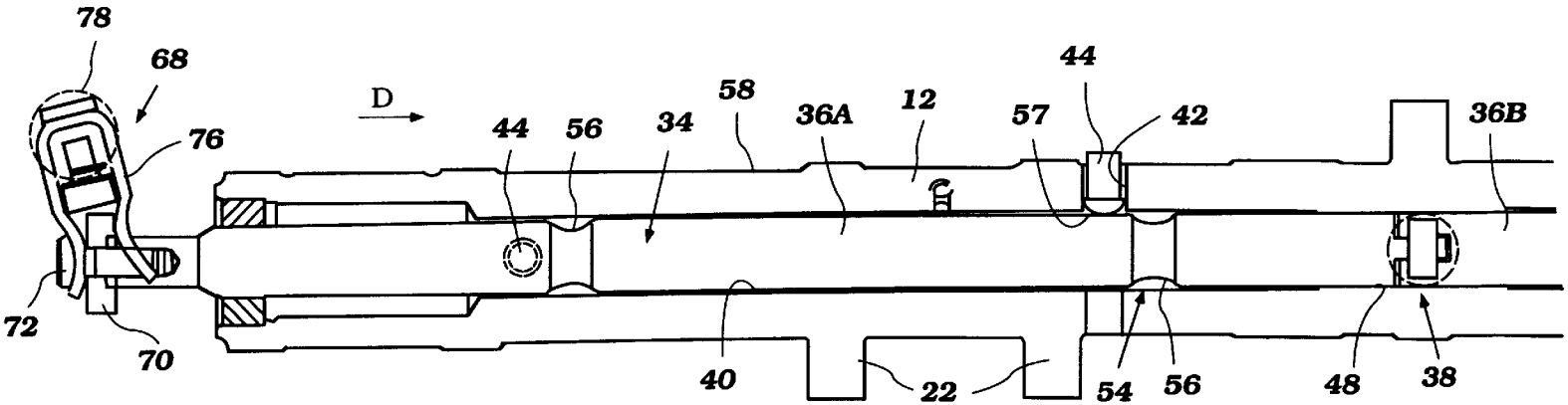
FIG. 6B is an enlarged cross-sectional view of a portion of the exhaust camshaft the decompression shaft of FIG. 2B, showing the decompression system in an activated position.

With particular reference to FIGS. 4, 6A and 6B, the operation of the decompression system 16 will be described in more detail. When the bowden-wire 84 is pulled in the direction indicated by arrow B in FIG. 4, the bracket 82 and the clamp 76 rotate about the axis 80 as indicated by arrow C. As shown in FIGS. 6A and 6B, this rotation pushes the decompression shaft 34 in the direction indicated by arrow D.

In the initial deactivated position (FIG. 6A), the grooves 56 are aligned with the pin holes 42. As such, the decompressions pins 44, which are biased towards the longitudinal axis 41, sink into the grooves 56 and do not extend significantly past the outer surface 58 of the camshaft 12. Thus, in the non-activated position, the decompression pins have no or a very small effect on the position of the corresponding exhaust valve 26. As the decompression shaft 34 is moved in the direction of arrow D, the decompression shaft 34 is moved to the activated position (FIG. 6B). In the position, the decompression pins 44 are no longer aligned with the grooves 56. As such, the ends of the decompression pins 44 are forced out of the pin holes 42 such that the decompression pins 44 protrude from the outer periphery 58 and push on the bearing surface 30 of the exhaust valve 26 during the compression stroke. In this manner, the decompression pins 44 "lift" the exhaust valves 26 and effectively reduce the effective compression ratio of the engine. Thus, longitudinal movement of the decompression shaft 34 switches the decompression system 16 between the activated and non-activated states. As the decompression shaft 34 moves longitudinally the grooves 56 and the cam surface 59 of the pin 44 glide over each other such that the movement of the decompression shaft is smooth.

The decompression system 16 described above has several advantages. For example, because the decompression shaft 34 is formed in two portions 36a, 36B, the decompression shaft 34 can be manufactured more easily and more reliably as compared to a single decompression shaft. This is particularly advantageous for engines with several cylinders, wherein the camshafts are particularly long. In such engines, the bore 40 of the camshaft 12 maybe difficult to machine accurately.

Another advantage of the preferred embodiment is that the decompression shaft 34 is supported by a bearing surface 48, which is preferably located at the junction 38. The remaining portions 46A, 46B, 46C of the bore 40 have diameter larger than the decompression shaft 34. As such, the remaining portions 46A, 46B, 46C of the bore 40 can be less smooth and machine less accurately than the bearing surface 48. This also reduces the costs of manufacturing and assembling the decompression system 16.

In the illustrated embodiment described above, the decompression shaft 34 moves longitudinally along the longitudinal axis 41 of the camshaft 12. As such, longitudinally movement of the decompression shaft 34 is used to actuate the decompression pins 44. In a modified embodiment, the decompression system 16 can be arranged such that rotation of the decompression shaft 34 about the longitudinal axis 41 actuates the decompression pins 44. In such an arrangement, the decompression shaft 34 include cam surfaces that vary the diameter of the decompression shaft as the decompression shaft 34 is rotated. Thus, as the decompression shaft 34 is rotated in a first direction, the decompression pins 44 are pushed out of the pin holes 42 to impart lift to the exhaust valves 26. The drive apparatus 68 can be modified to impart rotation on the camshaft 12. The rotation of the cam shaft may be automatic in response to the rotational speed of the engine. See e.g., U.S. Pat. No. 6,073,599, which is hereby expressly incorporated by reference herein. In such an arrangement, the decompression shaft preferably rotates with the camshaft 12.

In the illustrated embodiment, the camshaft 12 rotates about the decompression shaft 34, which does not rotate. However, in a modified embodiment, the decompression shaft 34 can rotate with the camshaft 12. In one application of such an arrangement, the washer 70 can rotate with respect to the clamp 76, which can remain stationary. It should be noted that in such an arrangement the camshaft 12 and the decompression shaft 34 need not be coaxial.

In the illustrated embodiment, the decompression shaft 34 is positioned within the exhaust camshaft 12. However, it should be appreciated that the decompression shaft can be positioned within the intake camshaft 14 instead of or in addition to the exhaust camshaft 12.

Of course, the foregoing description is that of preferred embodiments of the invention and various changes, modifications, combinations and sub-combinations may be made without departing from the spirit and scope of the invention, as defined by the appended claims.

We claim:

1. A decompression system for a four-cycle engine comprising a camshaft, decompression shaft, and at least one decompression pin, the camshaft having at least one cam arranged to activate a valve of the engine, an internal bore that extends generally longitudinally with respect to the camshaft and at least one pin hole arranged generally perpendicular to the internal bore, the decompression shaft comprising a first longitudinal portion and a second separate longitudinal portion that are configured to fit within the internal bore of the camshaft, means for detachably coupling the first longitudinal portion of the decompression shaft to the second separate longitudinal portion of the decompression shaft such that longitudinal movement of the first portion in the bore is transferred to the second portion, the decompression shaft moveable between a first position and a second position and further comprising at least one cam surface having a first portion and a second portion, the cam surface arranged such that in the first position of the decompression shaft the first portion of the cam surface allows the decompression pin to withdraw and in a second position of the decompression shaft the second portion of the cam surface causes the decompression pin to protrude and lift the valve.

2. A decompression system as in claim 1, further comprising a biasing member to bias the decompression shaft in either the first or second position.

3. A method of assembling a decompression system for an engine comprising, forming a bore within the camshaft, the bore having a middle portion with a first diameter and a second portion with a second diameter that is larger than the first diameter, forming at least one pin hole in the camshaft, the pin hole extending generally perpendicular to a longitudinal axis of the camshaft, inserting a pin into the pin hole, forming a first portion of a decompression shaft, forming a second separate portion of a decompression shaft, detachably coupling the first portion of the decompression shaft to the second separate portion of the decompression shaft and inserting the first portion and the second separate portion of the decompression shaft into the bore such that longitudinal movement of the first portion in the bore is transferred to the second portion.

4. The method of assembling as in claim 3, comprising positioning the decompression shaft within the camshaft such that a junction between the first and second portions is located near a longitudinal center of the camshaft.

5. A decompression system for a four-cycle engine comprising a camshaft, decompression shaft, and at least one decompression pin, the camshaft having at least one cain arranged to activate a valve of the engine, an internal bore that extends generally longitudinally with respect to the camshaft, and at least one pin hole arranged generally perpendicular to the internal bore, the decompression shaft comprising a first longitudinal portion and a second longitudinal portion that are configured to fit within the internal bore of the camshaft, the decompression shaft moveable between a first position and a second position and further comprising at least one cam surface having a first portion and a second portion, the cam surface arranged such that in the first position of the decompression shaft the first portion of the cam surface allows the decompression pin to withdraw and in a second position of the decompression shaft the second portion of the cam surface causes the decompression pin to protrude and lift the valve, wherein the first portion and the second portion of the decompression shaft are coupled together by a pin.

6. A decompression system for a four-cycle engine comprising a camshaft, decompression shalt and at least one decompression pin, the camshaft having at least one cam arranged to activate a valve of the engine, an internal bore that extends generally longitudinally with respect to the camshaft, and at least one pin hole arranged generally perpendicular to the internal bore, the decompression shaft comprising a first longitudinal portion and a second longitudinal portion that are configured to fit within the internal bore of the camshaft, the decompression shaft moveable between a first position and a second position and further comprising at least one cam surface having a first portion and a second portion, the cam surface arranged such that in the first position of the decompression shaft the first portion of the cam surface allows the decompression pin to withdraw and in a second position of the decompression shaft the second portion of the cam surface causes the decompression pin to protrude and lift the valve, wherein one end of the decompression shaft extends past an end of the camshaft and the one end of the decompression shaft is coupled to drive apparatus for moving the decompression shaft between the first and second positions, the one end of the decompression shaft comprising a distal portion with a first diameter, a tapered portion, and a proximal portion with a second diameter, the first diameter being smaller than the second diameter and the tapered portion extending from the proximal portion to the distal portion.

7. A decompression system for a four-cycle engine comprising a camshaft, decompression shaft, and at least one decompression pin, the camshaft having at least one cam arranged to activate a valve of the engine, an internal bore that extends generally longitudinally with respect to the camshaft, and at least one pin hole arranged generally perpendicular to the internal bore, the decompression shaft comprising a first longitudinal portion and a second separate longitudinal portion that are configured to fit within the internal bore of the camshaft, the first and second longitudinal portions including inter-engaging structures that detachably couple the second longitudinal portion to the first longitudinal portion such that longitudinal movement of the first longitudinal portion in the bore is transferred to the second longitudinal portion, the decompression shaft moveable between a first position and a second position and further comprising at least one cam surface having a first portion and a second portion, the cam surface arranged such that in the first position of the decompression shaft the first portion of the cam surface allows the decompression pin to withdraw and in a second position of the decompression shaft the second portion of the cam surface causes the decompression pin to protrude and lift the valve.

8. A decompression system as in claim 7, wherein the decompression shaft moves longitudinally with respect to a longitudinal rotational axis of the camshaft when moving between the first position and the second position.

9. A decompression system as in claim 7, wherein first and second bearings journal the decompression shaft for rotation with respect to the camshaft.

10. A decompression system as in claim 7, wherein the first portion of the decompression shaft is journaled for longitudinal movement within the camshaft by a first bearing positioned within the bore and the second portion of the decompression shaft is journaled for movement within the camshaft by a second bearing also positioned within the bore.

11. A decompression system as in claim 10, wherein a coupling point between the first and second portions of the decompression shaft is supported by a third bearing.

12. A decompression system as in claim 11, wherein the decompression shaft is supported in the camshaft only by the first, second and third bearings.

13. A decompression system as in claim 11, wherein the third bearing is formed by an inner wall of the camshaft's internal bore.

14. A decompression system as m claim 11, wherein the third bearing also journal the decompression shaft for rotation with respect to the camshaft.

15. A decompression system as in claim 7, wherein the first and second bearings are located near the ends of the camshaft.

16. A decompression system as in claim 7, wherein a coupling point between the first and second portions of the decompression shaft is located near a longitudinal center of the camshaft.

17. A decompression system as in claim 7, wherein one end of the decompression shaft extends past an end of the camshaft.

18. A decompression system as in claim 17, wherein the one end of the decompression shaft is coupled to drive apparatus for moving the decompression shaft between the first and second positions.

19. A decompression system as in claim 17, wherein the one end of the decompression shaft comprises a distal portion with a first diameter, a tapered portion, and a proximal portion with a second diameter, the first diameter being smaller than the second diameter and the tapered portion extending from the proximal portion to the distal portion.

20. A decompression system as in claim 7, wherein the camshaft is an exhaust camshaft of the engine.

21. A decompression system for a four-cycle engine comprising a camshaft, decompression shaft, and at least one decompression pin, the camshaft having at least one cam arranged to activate a valve of the engine, an internal bore that extends generally longitudinally with respect to the camshaft, and at least one pin hole arranged generally perpendicular to the internal bore, the decompression shaft comprising a first longitudinal portion and a second separate longitudinal portion that are configured to fit within the internal bore of the camshaft, the decompression shaft moveable between a first position and a second position and further comprising at least one cam surface having a first portion and a second portion, the cam surface arranged such that in the first position of the decompression shaft the first portion of the cam surface allows the decompression pin to withdraw and in a second position of the decompression shaft the second portion of the cam surface causes the decompression pin to protrude and lift the valve, and a coupling member for detachably coupling the first longitudinal portion of the decompression shaft to the second separate longitudinal portion of the decompression shaft.

22. A decompression system as in claim 21, wherein the decompression shaft moves longitudinally with respect to a longitudinal rotational axis of the camshaft when moving between the first position and the second position.

23. A decompression system as in claim 21, wherein first and second bearings journal the decompression shaft for rotation wit respect to the camshaft.

24. A decompression system as in claim 23, wherein the first portion of the decompression shaft is journaled for longitudinal movement within the camshaft by a first bearing positioned within the bore and the second portion of the decompression shaft is journaled for movement within the camshaft by a second bearing also positioned within the bore.

25. A decompression system as in claim 24, wherein a coupling point between the first and second portions of the decompression shaft is supported by a third bearing.

26. A decompression system as in claim 25, wherein the decompression shaft is supported in the camshaft only by the first, second and third bearings.

27. A decompression system as in claim 25, wherein the third bearing is formed by an inner wall of the camshaft's internal bore.

28. A decompression system as in claim 25, wherein the third bearing also journal the decompression shaft for rotation with respect to the camshaft.

29. A decompression system as in claim 25, wherein the first and second bearings are located near the ends of the camshaft.

30. A decompression system as in claim 21, wherein a coupling point between the first and second portions of the decompression shaft is located near a longitudinal center of the camshaft.

31. A decompression system as in claim 21, wherein one end of the decompression shaft extends past an end of the camshaft.

32. A decompression system as in claim 21, wherein the one end of the decompression shaft is coupled to drive apparatus for moving the decompression shaft between the first and second positions.

33. A decompression system as in claim 31, wherein the one end of the decompression shaft comprises a distal portion with a first diameter, a tapered portion, and a proximal portion with a second diameter, the first diameter being smaller than the second diameter and the tapered portion extending from the proximal portion to the distal portion.

34. A decompression system as in claim 21, wherein the camshaft is an exhaust camshaft of the engine.

* * * * *

UNITED STATES PATENT AND TRADEMARK OFFICE

CERTIFICATE OF CORRECTION

PATENT NO. : 6,789,521 B2
APPLICATION NO. : 10/117920
DATED : September 14, 2004
INVENTOR(S) : Takashi Ashida and Atsushi Sawabuchi It is certified that error appears in the above-identified patent and that said Letters Patent is hereby corrected as shown below:

Column 3, Line 27, delete "(e.g.,." and insert --(e.g., --, therefor.

Column 5, Line 22, delete "64,which" and insert --64, which --, therefore.

Column 5, Line 64, delete "nonactivated" and insert -- non-activated --, therefore.

Column 7, Line 25, In Claim 1, after "camshaft" insert --, --.

Column 7, Line 67, In Claim 5, delete "cain" and insert -- cam --, therefor.

Column 8, Line 19, In Claim 6, delete "shalt" and insert -- shaft, --, therefor.

Column 9, Line 24, In Claim 14, delete "m" and insert -- in --, therefor.

Column 9, Line 27, In Claim 15, delete "claim 7," and insert -- claim 11, --, therefor.

Column 10, Line 17, In Claim 23, delete "wit" and insert -- with --, therefor.

Signed and Sealed this

Twenty-first Day of November, 2006

JON W. DUDAS
*Director of the United States Patent and Trademark Office*